United States Patent [19]

Hayes et al.

[11] 3,934,598

[45] Jan. 27, 1976

[54] COSMETIC HOLDER AND APPLICATOR

[75] Inventors: Thomas H. Hayes, Westport, Conn.; Efrem Ostrowsky, Highland Park, Ill.

[73] Assignee: VCA Corporation, Greenwich, Conn.

[22] Filed: July 10, 1974

[21] Appl. No.: 487,309

Related U.S. Application Data

[63] Continuation of Ser. No. 323,838, Jan. 15, 1973, abandoned.

[52] U.S. Cl. ..... 132/88.7; 401/59

[51] Int. Cl.[2] ..... A45D 40/26

[58] Field of Search ..... 132/88.7, 83; 401/11, 58, 401/59, 60–62; 15/209; 206/56

[56] References Cited

UNITED STATES PATENTS

| | | | |
|---|---|---|---|
| 1,810,249 | 6/1931 | Koehler | 401/59 |
| 1,948,074 | 2/1934 | Matheret et al. | 401/59 |

*Primary Examiner*—G. E. McNeill

*Attorney, Agent, or Firm*—H. Gibner Lehmann; K. Gibner Lehmann; E. Donald Mays

[57] ABSTRACT

A cosmetic stick holder and applicator device such as a lipstick case, comprising an essentially cylindrical casing open at one end and containing a product-carrying cup which is movable between advanced and retracted positions. A flexible push-pull actuator strip located in the casing has one end connected to the cup to actuate the same, and has at its other end a concave-convex closure member of arcuate cross section. The cup, push-pull strip and closure member are guided and controlled by an internal curved guide member which is closely confined within the casing and by guide means in the casing, all in such a manner that the casing can be completely round while at the same time the push-pull strip, when operated by a finger piece protruding from the casing, can advance or retract the cup and its product, and simultaneously automatically open or close the casing at its open end, depending on the location of the cup and product.

17 Claims, 16 Drawing Figures

COSMETIC HOLDER AND APPLICATOR

CROSS REFERENCES TO RELATED APPLICATION

This application is a continuation of copending application Ser. No. 323,838 now abandoned, entitled Cosmetic Holder and Applicator and filed Jan. 15, 1973 in the names of Thomas H. Hayes and Efrem Ostrowsky.

BACKGROUND

This invention relates generally to cosmetic stick holder and applicator devices such as lipstick cases, and more particularly to devices of this type which employ a flexible strap operator to actuate a product-carrying movable cup.

In the past a large number of cosmetic or lipstick holders and applicators have been proposed and produced. One class of prior device of this type employed a flexible push-pull strip or band which was fastened at one end to the cup and adjacent its other end to a finger piece which extended outwardly through a slot in the wall of the casing. The strip traveled along a guide having a 180° bend, such that sliding movement of the finger piece in a direction away from the open end of the casing caused advancement of the cup and stick product whereby the latter would protrude through the open casing end. In several of these prior constructions, the free end of the actuator strip was made sufficiently long so as to be capable of extending across the open end of the casing, the strip being also wide enough to constitute a closure therefor when the cup was moved to its retracted position.

There were a number of disadvantages and drawbacks in these prior devices. In virtually all constructions heretofore proposed, the cases were either wholly or at least in part, of square or rectangular cross section. This was due to the fact that the actuator strips employed therein were of appreciable width whereby their side edges extended along widely spaced, longitudinal portions of the casing. Such rectangular dispensers were difficult to manipulate and use, since they could not be easily twirled in the manner of a cylinder, in the hand of the user during application. It is well recognized that such rolling or twirling movement is desirable to facilitate the application of lipstick wax, for example.

In addition, these prior devices were frequently complex and difficult to assemble. Where the prior constructions employed mating casing halves, the strip and cup had to be applied to one casing half during the assembly and held in a precise, given position while the other casing half was applied. Frequently the strip and cup would undergo a slight shift in position during this step, causing difficulty in applying the second casing half. As a result the assembly time was often excessive. Finally, the prior devices were large and cumbersome in a relative sense, and were not in keeping with the aesthetic requirements of this type of cosmetic article.

SUMMARY

The above drawbacks and disadvantages of prior cosmetic holder or lipstick devices are obviated by the present invention, which has for an object the provision of an improved holder and applicator of the flexible push-pull actuator strip type, wherein the casing need not be of square or rectangular cross section but instead can have a precisely cylindrical shape, thereby to greatly facilitate the twirling or rolling movements found to be desirable by the average, typical user. A related object of the invention is the provision of a holder-applicator device as above characterized, which has but a single moving part and which is constituted of a minimum number of separate pieces. Still another object is the provision of a cosmetic holder device of the kind indicated, which can be readily assembled with a minimum of time and effort and with virtually no interference between the various parts during assembly.

The above objects are accomplished by providing a cosmetic stick holder and applicator which comprises a hollow, essentially cylindrical casing having an opening at one end, in combination with a unique internal curved guide member that is closely confined within the casing. The device has a cup that is movable longitudinally in the casing between advanced and retracted positions, and a very narrow, flexible push-pull actuator strip attached at one end to the cup. Guide means in the casing, including a direction-reversing portion, confine the strip for opposite movement within the casing. A novel, oval closure member having a convex-concave shape is connected to the other end of the push-pull strip. The casing has a longitudinal slot which guides a finger piece, the latter being attached to the push-pull strip at a point thereon adjacent the closure member. The arrangement is such that the closure member can move along the inside surface of the casing, from a retracted position intermediate the casing ends to an advanced, tilted position wherein it extends across and closes the open end of the casing in response to sliding of the finger piece along the casing slot in a given direction. Because the push-pull strip is very narrow, the casing can be made essentially perfectly circular on the outside, whereby the main objective of the invention is attained.

Other features and advantages will hereinafter appear.

In the drawings, illustrating a preferred embodiment of the invention:

Figure 15:
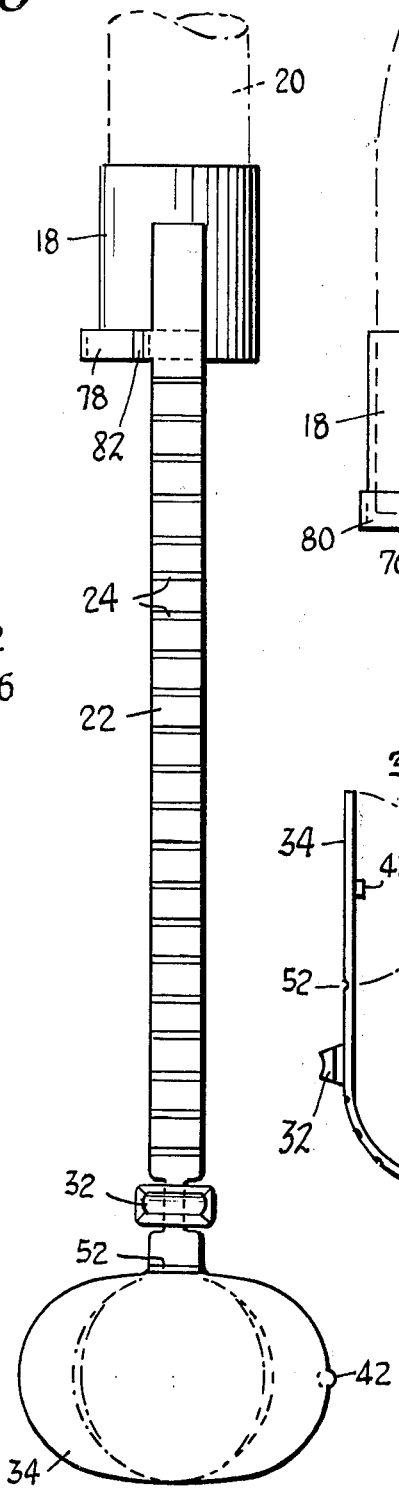
FIG. 15 is a plan view of the cup, push-pull strip and closure member as provided by the present invention, showing them constituted as a single molded piece.
Figure 16:
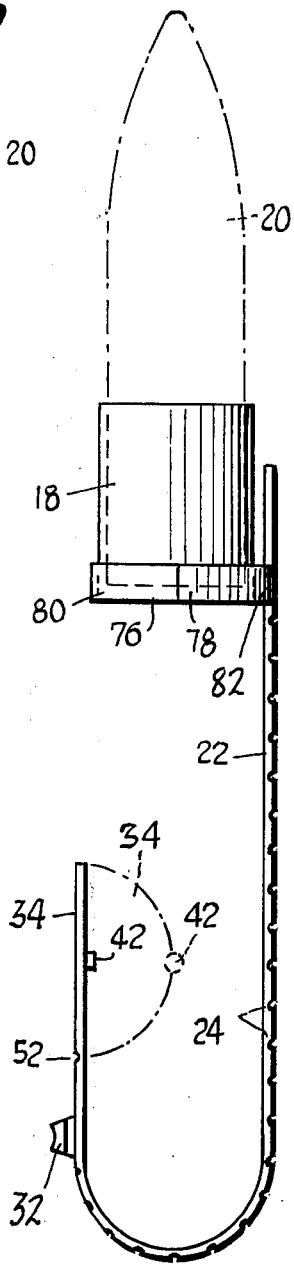
FIG. 16 is a view of the cup, push-pull strip and closure member shown in the relative positions occupied when the cup is advanced.

Referring first to FIGS. 1–5 and 14 there is illustrated a lipstick case generally designated by the numeral 10, comprising a hollow outer casing 12 having an opening 14 at one end which is hereinafter referred to as the top of the casing. In accordance with the present invention the casing 10 is essentially perfectly cylindrical on the outside, and there is provided within the casing a unique internal guide member 16 which is closely confined. The guide member 16 is particularly illustrated in FIGS. 12 and 13, being shown as elongate and comprising essentially a half of a cylinder for the major portion of its length. The device 10 further comprises a cup 18 disposed in the casing 12 and adapted to carry a cosmetic product such as a lipstick 20 or the like. The cup 18 is longitudinally movable between an advanced position illustrated in FIG. 5 and a retracted position shown in FIG. 4. Attached to one side of the cup 18 is an end portion of a bendable, tenuous, elongate flat push-pull strip 22 which is disposed within the casing and capable of shifting the cup in opposite directions. The strip 22 is both resilient and flexible and, as illustrated in FIGS. 15 and 16, has a plurality of transverse thin sections 24 along its length to facilitate the bending movement thereof.

In accordance with the present invention there is further provided a novel guide means for the strip 22 in the casing, said means including a direction-reversing guide 25 (FIGS. 4, 5 and 12) carried by the internal guide member 16. The guide means confines portions of the push-pull strip 22 to guide the latter for movement along diametrically opposed sections 26 and 28 of the casing as illustrated in FIGS. 7–11. The guide means further comprises a thin longitudinal edge 27 of the internal guide member 16 and a shoulder 29 of said member both of which confine portions of the strip 22 as seen in FIGS. 7–10. As shown in FIGS. 8–11, the guide means comprises a part of the inner surface of the casing adjacent the diametrically opposed portions 26 and 28, and also the outer surface of the internal guide member 16. A longitudinally extending slot 30 is provided in the casing 12 adjacent one portion of the strip 22, and a finger piece 32 extends outwardly therethrough and is connected to the push-pull strip 22 at a point intermediate its ends, to enable sliding movement of the strip in the casing to be effected by the fingers of the user.

Figure 7:
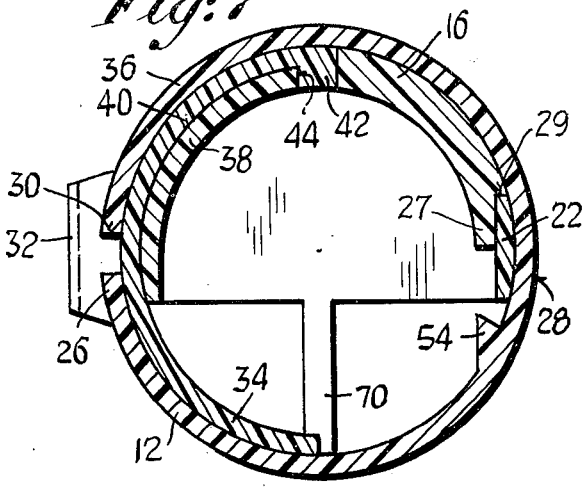
FIG. 7 is a horizontal section taken on line 7—7 of FIG. 5.
Figure 8:
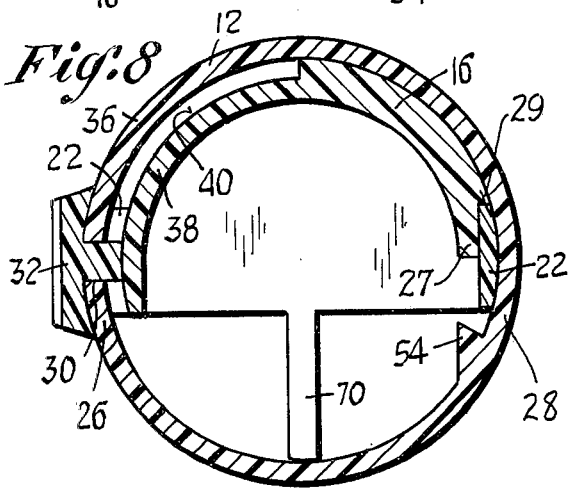
FIG. 8 is a horizontal section taken on line 8—8 of FIG. 5.

Further in accordance with the present invention there is provided a novel closure member 34 of thin, wafer-like construction. The closure member 34 is illustrated in FIGS. 4–7, 15 and 16, having an arcuate cross section and a generally oval configuration when flattened (FIG. 15). Referring to FIG. 7 it can be seen that the casing 12 and internal guide member 16 have spaced-apart portions 36 and 38 respectively, defining between them a guide track 40. The closure member is molded in a manner to have a convex-concave shape which enables it to nest between the spaced-apart portions 36 and 38. The assemblage comprising the cup 18, push-pull strip 22, finger piece 32 and closure member 34 are molded from plastic as a single, integral piece, thus minimizing manufacturing cost and assembly time.

Figures 1, 2, 3, 4, 5:
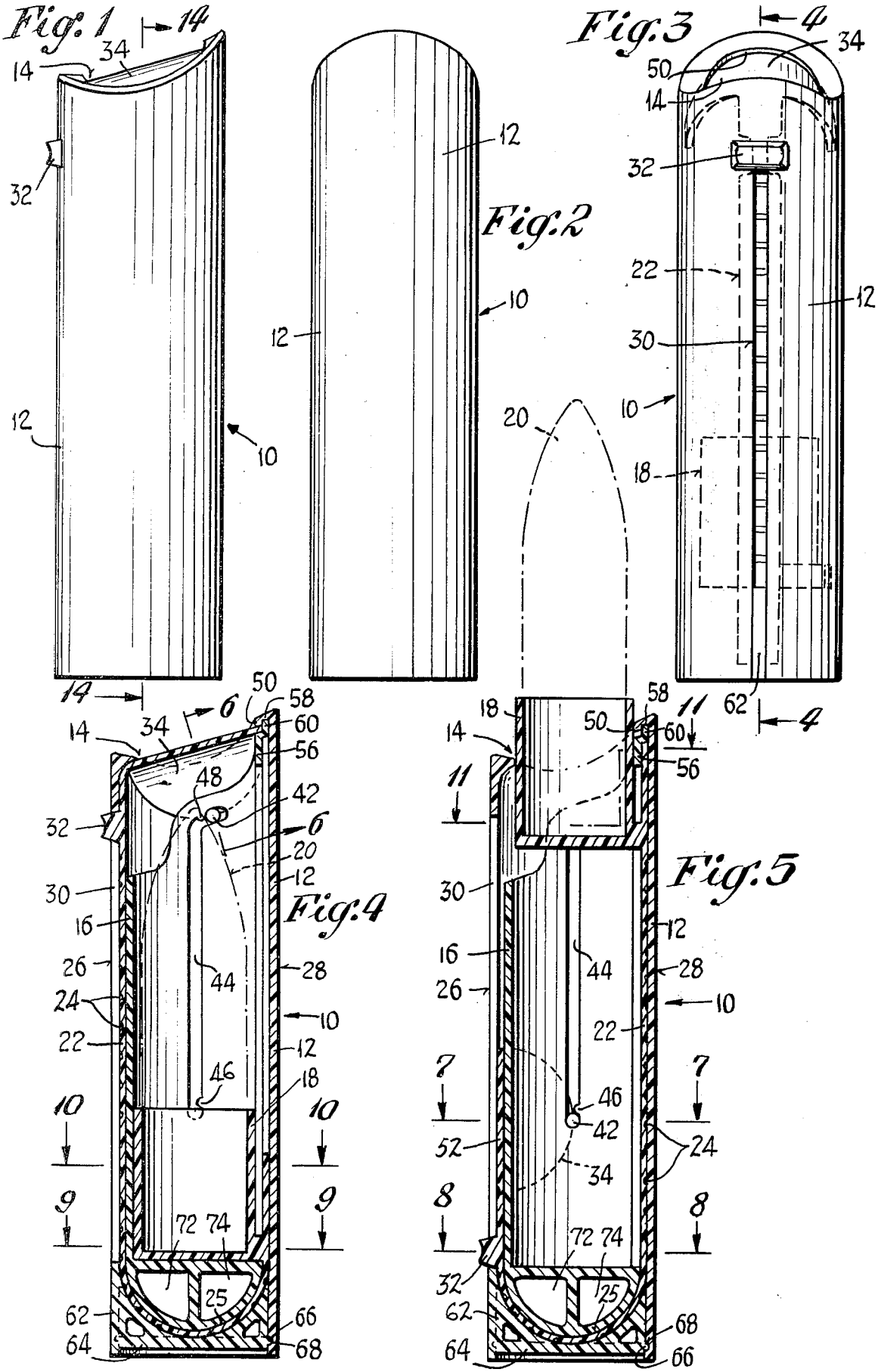
FIG. 1 is a side elevational view of the cosmetic holder and applicator device of the present invention.
FIG. 2 is a front elevational view of the cosmetic holder and applicator device.
FIG. 3 is a rear elevational view of the cosmetic holder and applicator device.
FIG. 4 is a vertical section taken on line 4—4 of FIG. 3.
FIG. 5 is a vertical section of the cosmetic holder and applicator device, particularly showing the product cup in its advanced position.
Figure 6:
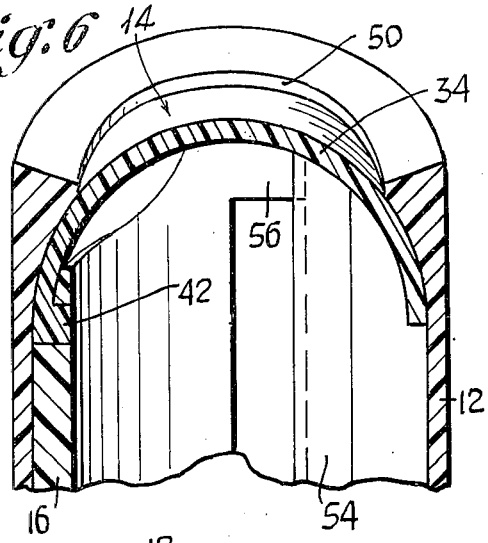
FIG. 6 is a fragmentary section taken on line 6—6 of FIG. 4.

Referring to FIGS. 4–7, the closure member 34 is provided with an inwardly projecting pin 42 which is received in an elongate slot 44 (FIG. 12) in the internal guide member 16. Near opposite ends of the slot 44 are detent nibs 46 and 48 respectively, which cooperate with the pin 42 of the closure member to releasably detain the latter in either an open, retracted position as illustrated in FIG. 5, or a closed, tilted position wherein it extends across and closes the open end 14 of the casing as illustrated in FIG. 4. The open casing end 14 has an internal lip 50 providing an opening slightly smaller than the size of the closure member 34. In addition, the push-pull strip 22 has a bending line of weakness 52 at a point between the finger piece 32 and the closure member 34. Thus, the pin 42, slot 44 and internal lip 50 constitute means for effecting tilting of the closure member as it approaches the open end 14 of the casing to the position of FIG. 4.

Referring now to FIGS. 6–11 and 14, the inner surface of the casing is provided with an elongate, internal positioning shoulder 54 which is engageable with a thin projecting tip portion 56 (FIGS. 12, 13) of the internal guide member 16 to firmly position the latter in the casing. The casing also has an undercut surface 58 adjacent the lip 50 which receives the reduced tip portion 60 (FIGS. 12, 13) of the internal guide member to thereby lock the member 16 in a fixed position. The internal guide member is further provided with an alignment key 62 at the end opposite the tip portion 56, the key being receivable in the slot 30 of the casing, to thereby secure this end against movement with respect to the casing. The internal guide member also has a disk-shaped bottom portion 64 and an annular retainer bead 66 which is received in a corresponding annular groove 68 on the inner surface of the casing 12, the bead and groove constituting cooperable snap retainer means for retaining the internal guide member in the casing once it is assembled thereto.

Figure 12:
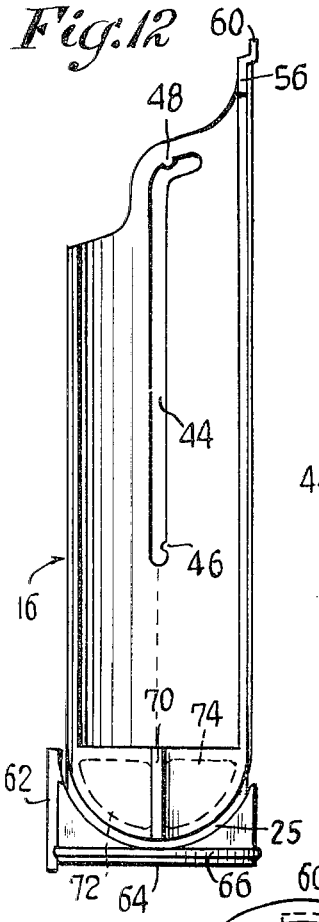
FIG. 12 is a side elevation of the internal guide member, also illustrated in FIGS. 4 and 5, as provided by the present invention.
Figure 13:
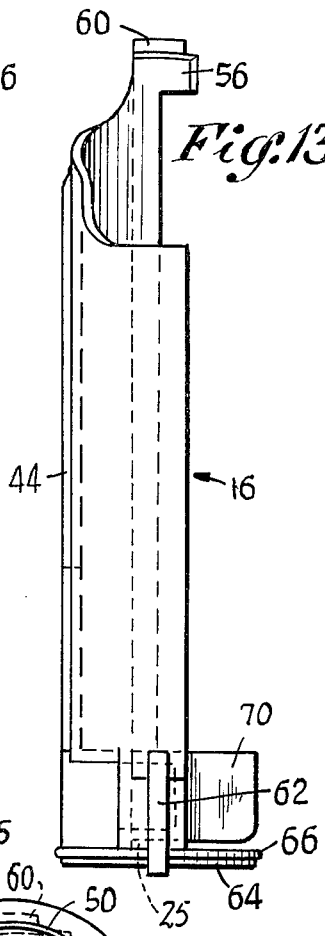
FIG. 13 is a front elevation of the internal guide member of FIG. 12.
Figure 14:
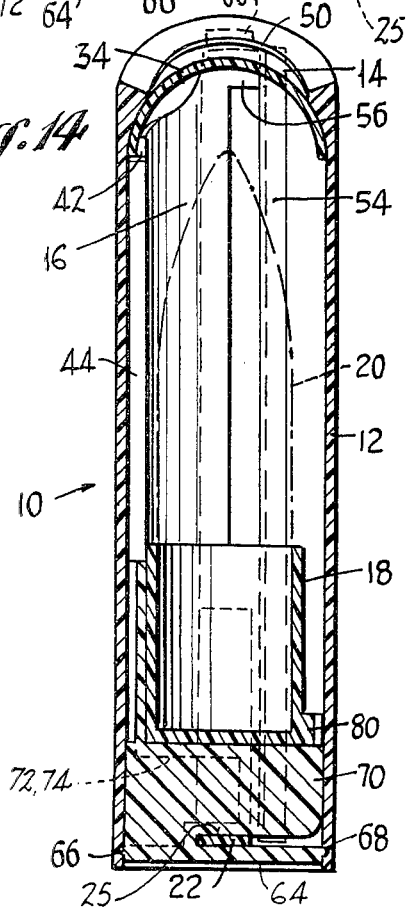
FIG. 14 is a vertical section taken on line 14—14 of FIG. 1.

As best illustrated in FIG. 13 the internal guide member 16 also has a projecting positioning vane 70 which engages the inner surface of the casing wall as shown in FIG. 14 and maintains the guide member in a central position with respect to the casing. As best illustrated in FIGS. 4, 5 and 12 the body portion of the internal guide member 16 adjacent the direction-reversing guide has two cored-out portions 72 and 74 respectively, the purpose of which is to save material and to facilitate rapid curing of the member immediately after it is molded.

Figure 9:
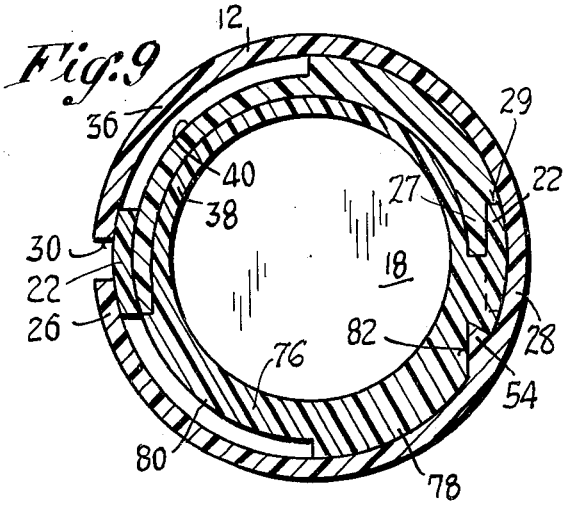
FIG. 9 is a horizontal section taken on line 9—9 of FIG. 4.
Figure 10:
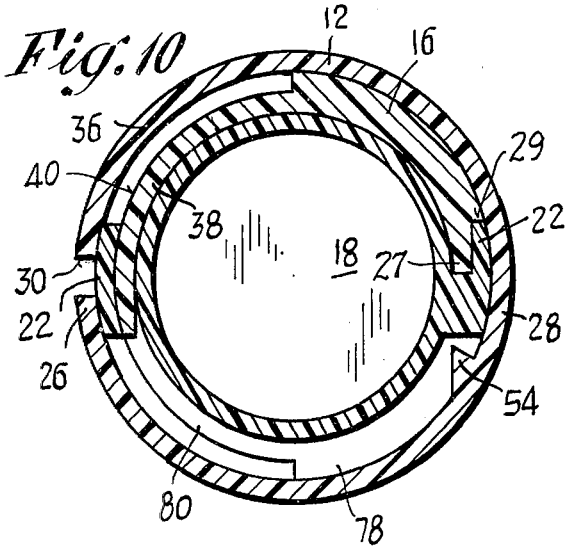
FIG. 10 is a horizontal section taken on line 10—10 of FIG. 4.
Figure 11:
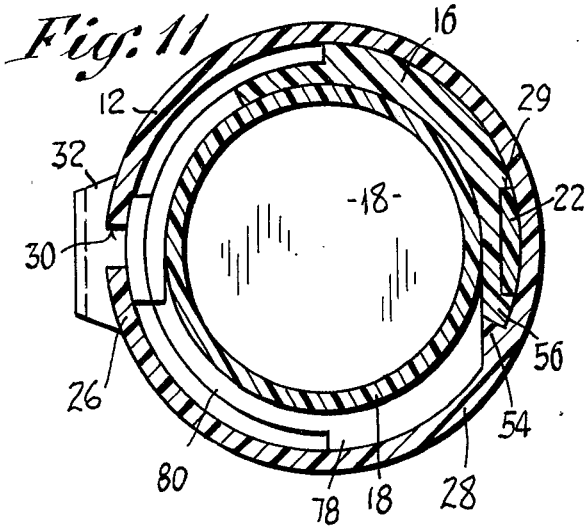
FIG. 11 is a horizontal section taken on line 11—11 of FIG. 5.

Referring now to FIGS. 9 and 16 it can be seen that the cup 18 has a base portion 76, one part 78 of which is of increased thickness and another part 80 of which is of intermediate thickness. The part 78 also has a notch 82 which receives the internal shoulder 54 of the casing, the shoulder providing a guide for the cup as it moves longitudinally. The part 78 slidably engages the inner wall of the casing, while the part 80 is spaced therefrom to enable the closure member to occupy the space between it and the casing wall, as illustrated in FIG. 7.

The assembly of the one piece cup, push-pull strip and closure member of FIG. 16 and the internal guide member into the casing is readily accomplished with a minimum of time and effort. The assemblage of FIG. 16 is first applied, having roughly the relative configuration illustrated therein, to the internal guide member 16 of FIGS. 12 and 13 such that the closure member 34 engages the outside surface of the internal guide member 16, with the pin 42 engaging the slot 44 and with the push-pull strip 22 inserted into the reversing guide 25. The portion of the strip 22 which is adjacent the cup 18 will lie along the right edge of the internal guide member 16 in FIG. 12. Then, with the strip held taut, this assemblage is slid into the casing 12 from the end thereof opposite the opening 14, (the key 62 being aligned with the slot 30 of the casing) until the annular bead 66 of the internal guide member snaps into the groove 68 in the casing (see FIGS. 4 and 5). The entire operation takes less than 10 seconds, and there is encountered virtually no interference between the various parts during assembly. Also, the above arrangement has the advantage that the installation of the particular cosmetic stick 20 to be employed can be undertaken at a later time following this assembly.

The operation of the assembled cosmetic holder and applicator is readily understood by referring to FIGS. 4 and 5. When the cup 18 is in its advanced position illustrated in FIG. 5, the closure member 34 being of cylindrical cross-section, occupies a retracted position between the cylindrical wall of the casing 12 and outer surface of the portion 38 of the internal guide member 16 as illustrated in FIG. 7. It can be seen that for this position, the finger piece 32 is adjacent the key 62, the latter serving as a stop therefor. When the finger piece 32 is moved in a direction toward the opening 14, the cup 18 will be retracted as the closure member advances toward the opening. When the member arrives at the opening, the lip 50 and the pin 42 traveling in the slot 44 cause a tilting of the member whereby it finally assumes the sealing position of FIG. 4, engaging the lip 50 and forming therewith a tight seal. Such tilting movement is possible due to the cut-away portion of the internal guide member near the tip 56, as best illustrated in FIG. 12.

The above construction is seen to have a number of advantages and unique features. It is to be noted that the closure member is guided along one side only, by means of a single pin 42 travelling along the slot 44 of the guide member 16. Such an arrangement makes possible the half-cylinder configuration of this member. In addition, the number of separate pieces is kept to an absolute minimum, and there is but a single moving part. Finally, the bending of the strip 22 as it passes around the direction reversing guide 24 is greatly facilitated by the transverse thin portions 24. In consequence, a smooth operation, free of jamming or bending, is realized.

From the above it can be seen that we have provided a novel and improved, outwardly cylindrical cosmetic stick dispenser and applicator device which is at the same time simple, easy to manufacture and assemble, and also reliable in operation. The cylindrical casing enables the device to be easily twirled in the hand of the user, this movement being highly desirable during the application of lipstick. The device of the invention thus represents a distinct advance and improvement in the cosmetic field.

Variations and modifications are possible without departing from the spirit of the invention.

I claim:

1. A cosmetic stick holder and applicator device, comprising in combination:

a. a hollow, essentially cylindrical casing having an opening at one end, b. an internal curved guide member closely confined within the casing, c. a cup disposed in said casing and adapted to carry the cosmetic stick, said cup being movable longitudinally between advanced and retracted positions, d. a bendable, tenuous, elongate, flat push-pull strip disposed within the casing and having one end portion connected to the cup to shift the latter, e. guide means for said strip, including a direction reversing guide carried by the internal guide member, confining opposite end portions of said strip for opposite movements respectively within the casing, said strip extending along and closely adjacent to diametrically opposed portions of said casing, f. said casing having a longitudinal slot extending along the other end portion of said strip, g. a finger piece connected with said other end portion of the push-pull strip and extending outwardly through said slot, h. a thin, waferlike closure member having a convex-concave shape, said member being of arcuate cross-section and having a generally oval configuration when flat, i. said closure member being connected to the other end of said push-pull strip and being movable along the inside surface of said casing from a retracted position intermediate the casing ends to an advanced, tilted position wherein it extends across and closes the open end of the casing in response to sliding of the finger piece along the slot of the casing for the purpose of shifting the cup and cosmetic stick carried thereby from the advanced to the retracted positions, and j. cooperable means on the internal guide member and closure member for effecting said tilting of the latter as it approaches the open end of the casing.

2. The invention as set forth in claim 1, wherein:

a. said push-pull strip has a bending line of weakness at a point thereon between the closure member and the finger piece.

3. The invention as set forth in claim 1, wherein:

a. said stick-carrying cup, push-pull strip, closure member and finger piece are molded as a single integral piece.

4. The invention as set forth in claim 1, wherein:

a. said means for effecting the tilting of the closure member comprises a pin carried thereby, b. said internal guide member having a slot in which the pin travels during movement of the closure member.

5. The invention as set forth in claim 4, and further including:

a. detent nibs disposed near opposite ends of the slot of the internal guide member, b. said detent nibs being cooperable with the pin of the closure member when the latter is respectively in its retracted and its advanced, tilted positions.

6. The invention as set forth in claim 1, wherein:

a. said casing has an elongate internal positioning shoulder engageable with a portion of said internal guide member to position the latter in the casing.

7. The invention as set forth in claim 1, wherein:

a. said push-pull strip has a plurality of transverse thin sections along its length to facilitate bending thereof as it passes around the direction reversing guide of the internal guide member.

8. The invention as set forth in claim 1, and further including:

a. a cooperable snap retainer means on the casing and on the internal guide member, tending to retain the latter in the casing once it is assembled thereto.

9. The invention as set forth in claim 1, wherein:

a. said casing and said internal guide member have spaced apart portions, defining between them a guide track, b. said closure member being adapted to travel along said track so as to be guided thereby.

10. The invention as set forth in claim 1, wherein:

a. said internal guide member has an alignment key, receivable in the slot of the casing when the guide member is assembled thereto, thereby to orient the guide member with respect to the casing.

11. The invention as set forth in claim 1, wherein:

a. said internal guide member comprises essentially a half a cylinder for the major portion of its length, b. said direction reversing guide being disposed adjacent the end of the casing opposite to said open end.

12. The invention as set forth in claim 4, wherein:

a. said internal guide member comprises essentially a half a cylinder for the major portion of its length, b. said direction reversing guide being disposed adjacent the end of the casing opposite to said open end, c. said slot being disposed centrally in said guide member.

13. The invention as set forth in claim 4, wherein:

a. said slot has a laterally extending end portion adjacent the open end of the casing in which the pin rides to effect the tilting of the closure member.

14. The invention as set forth in claim 1, wherein:

a. said internal guide member has a closure disk disposed adjacent the end of the casing opposite to the open end thereof, b. said casing having an annular internal groove into which the closure disk snaps.

15. The invention as set forth in claim 1, and further including:

a. an internal lip around the open end of the casing, b. said lip being cooperable with the closure member to effect a tight seal therewith when in the advanced, tilted position.

16. The invention as set forth in claim 1, wherein:

a. said internal guide member has a thin projecting tip portion at one end, and b. cooperable keying means on the internal surface of the casing to receive the tip portion and to lock it in a fixed position.

17. The invention as set forth in claim 15, wherein:

a. said casing has an elongate internal positioning shoulder engageable with a portion of said internal guide member to position the latter in the casing.

* * * * *